US006962328B2

(12) United States Patent
Bergendahl

(10) Patent No.: US 6,962,328 B2
(45) Date of Patent: Nov. 8, 2005

(54) CABLE SAFETY SYSTEM

(75) Inventor: Peter Bergendahl, Ängelholm (SE)

(73) Assignee: TRN Business Trust, Dallas, TX (US)

( * ) Notice: Subject to any disclaimer, the term of this patent is extended or adjusted under 35 U.S.C. 154(b) by 50 days.

(21) Appl. No.: 10/442,597

(22) Filed: May 21, 2003

(65) Prior Publication Data

US 2003/0222254 A1 Dec. 4, 2003

Related U.S. Application Data

(60) Provisional application No. 60/383,653, filed on May 28, 2002.

(51) Int. Cl.[7] ..... E01F 15/00

(52) U.S. Cl. ..... 256/13.1; 256/1; 404/6; 404/10

(58) Field of Search ..... 256/1, 13.1, 19, 256/21, 32, 59; 404/6, 9, 10

(56) References Cited

U.S. PATENT DOCUMENTS

| | | | | |
|---|---|---|---|---|
| 2,265,698 A | | 12/1941 | Opgenorth | 256/13.1 |
| RE22,060 E | * | 4/1942 | Hayden et al. | 256/13.1 |
| 3,865,349 A | | 2/1975 | Leiblich | 256/47 |
| 4,501,411 A | | 2/1985 | Otaki | 256/13.1 |
| 4,623,127 A | | 11/1986 | Wier | 256/35 |
| 5,039,066 A | * | 8/1991 | Stacey | 256/13.1 |
| 6,065,738 A | | 5/2000 | Pearce et al. | 256/13.1 |
| 2002/0014620 A1 | | 2/2002 | Nilsson | 256/59 |
| 2002/0185639 A1 | * | 12/2002 | Galivan | 256/32 |

FOREIGN PATENT DOCUMENTS

| | | | |
|---|---|---|---|
| GB | 1012212 | 12/1965 | E01F 15/00 |
| GB | 2224529 A | 5/1990 | |

OTHER PUBLICATIONS

Letter dated Aug. 30, 2002 from Carol H. Jacoby, Director, Office of Safety Design to Mr. Rick Mauer at Marlon Steel Company. 5 Pages.

Trinity Industries Inc.'s, CASS Cable Safety System Brochure distributed Nov. 2002. 4 Pages.

* cited by examiner

*Primary Examiner*—Daniel P. Stodola
*Assistant Examiner*—Michael P. Ferguson
(74) *Attorney, Agent, or Firm*—Baker Botts L.L.P.

(57) ABSTRACT

A safety system including cables and support posts is provided. The safety system may be used to prevent vehicles from impacting with an associated roadside hazard. The safety system will typically maintain engagement between associated cables and support posts for a longer period of time as the posts are bent during a vehicle impact.

13 Claims, 5 Drawing Sheets

CABLE SAFETY SYSTEM

RELATED APPLICATION

This application claims the benefit of previously filed provisional application entitled "Cable Safety System," Ser. No. 60/383,653, filing date May 28, 2002.

TECHNICAL FIELD

The present invention is related to highway barriers and safety systems and more particularly to cable safety systems and associated posts.

BACKGROUND OF THE INVENTION

Cable safety systems and cable barriers have been installed along edges of roadways and highways for many years. Cable safety systems and cable barriers have also been installed along medians between roadways and/or highways. Cable safety systems generally include one or more horizontal cables attached to support posts. For some applications cable safety systems and cable barriers may reduce damage to an impacting vehicle and/or injury to occupants of the impacting vehicle as compared with other types of highway safety systems and highway barriers.

Cable safety systems are often designed and installed with at least one cable mounted horizontally on a plurality of generally vertical support posts. Many cable safety systems include three cables spaced vertically from each other on each support post. The number of cables may vary depending on factors such as the type of vehicles using the associated roadway and the hazard which requires installation of the cable safety system. The length of a cable safety system is generally determined based on the adjacent roadside hazard. Each cable is typically installed at a selected height relative to the ground and with selected vertical spacing between adjacent cables.

One recognized limitation of many cable safety systems is excessive deflection of associated cables during a vehicle impact. Deflection associated with a cable safety system may be larger than deflection of a convention W-beam guardrail when subjected to the same type of vehicle impact. Such deflection frequently determines maximum allowed spacing between adjacent posts for satisfactory performance of the cable safety system. Large deflection during a vehicle impact also increases the risk of the vehicle running over the cables and being exposed to the hazard which required installation of the cable safety system. Calculating performance of many cable safety systems is often difficult due to unpredictable interactions between associated posts and cables during a vehicle impact. Depending upon car type, speed and angle of impact, cables may release as far as ten (10) or most posts spaced ahead of the impact location. Cable release from post often causes much larger deflections than expected or calculated.

From full scale crash testing and from real life experience, it has been determined that keeping the length of unsupported cables as short as possible will generally reduce deflection. The longer the distance between adjacent posts supporting associated cables, the larger the deflection will generally be during a vehicle impact. An increased number of posts (shorter post spacing) will generally decrease deflection. However, shorter spacing between posts affects total cost of a cable safety system, not only material, but also installation time and cost.

During the past several years, cable safety systems have been used as an alternative to traditional W-beam guardrail systems. These cable safety systems address some of the weaknesses of prior cable safety systems by using prestressed cables and/or reducing spacing between adjacent posts to reduce deflection to an acceptable level. A consultant report "Dynamic Analysis of Cable Guardrail" issued in April 1994 by an ES-Consult in Denmark, established a model for various parameters which affect performance and design considerations for acceptable deflection of cable safety systems.

Cable safety systems are often more aesthetically appealing and minimize potential sight distance problems as compared with W-beam and thrie beam guardrail systems. Cable safety systems generally minimize snow accumulation on adjacent highways and roadways.

SUMMARY OF THE INVENTION

In accordance with teachings of the present invention, a cable safety system may be provided which overcomes many disadvantages and problems associated with prior cable safety systems and cable barriers. Vertical spacing between cables, vertical spacing of cables relative to an associated roadway and horizontal spacing between adjacent posts may be designed and selected in accordance with teachings of the present invention to allow the resulting cable safety system to satisfactorily function during a vehicle impact.

Technical benefits of the present invention include providing a cable safety system that maintains engagement between posts and associated cables for a longer period of time as the posts are bent from their normal, generally vertical position during a vehicle impact. A cable safety system incorporating teachings of the present invention also minimizes the number of times an installer must to go to each post to position associated cables with desired vertical spacing relative to each other and an adjacent roadway. The present invention reduces both cost and time required to install a cable safety system. Cable safety system installers are exposed to reduced risk of injury by traffic because the present invention generally reduces the number of times installers must go to each support post.

For some applications, a cable safety system formed in accordance with teachings of the present invention may require twenty percent (20%) fewer support posts and/or require placing less tension on associated cables as compared with prior cable safety systems. Support posts formed in accordance with teachings of the present invention preferably have generally symmetrical cross sections which are often more suitable for use as a single barrier along the edge of a roadway or for use as a median barrier. Such support posts often provide increased safety for all types of vehicles by optimizing the shape of each support post ("softer" support posts) to minimize vehicle damage and providing increased vertical spread between associated cables.

Additional technical benefits of the present invention include optimizing design of a cable safety system to provide satisfactory deflection characteristics with less tension required in the cables and greater spacing between support posts. Repairs may more easily be made to the cable safety system after a vehicle impact. The need for periodic re-tensioning of cables may be reduced or eliminated by the present invention.

Support post formed in accordance with teachings of the present invention are generally less likely to break loose and hang on associated cables during a vehicle impact. The support posts are generally less likely to become potential hazards capable of penetrating an impacting vehicle or of being projected into traffic. The present invention also eliminates sharp edges which are sometimes present on support posts associated with prior cable safety systems. Such sharp edges on prior posts often represent substantial risks for motorcycle riders.

A cable safety system incorporating teachings of the present invention generally reduces forces on occupants of a vehicle impacting the system. Support posts incorporating teachings of the present invention provide increased flexibility with respect to design requirements of an associated cable safety system such as spacing between posts, tension on cables and vertical spacing between cables. Support post formed in accordance with teachings of the present invention allow optimizing the design and installation of cable safety systems adjacent to curves in a highway or roadway and adjacent to slopes or inclines. Installation procedures may also be optimized to reduce both time and cost of initial installation and repair after a vehicle impact. The present invention may be used to form a wide variety of safety systems and barriers installed on a median between roadways and/or along the edge of a roadway.

Further technical benefits of the present invention include more predictable interaction between posts and cables during a vehicle impact with an associated cable safety system. The present invention allows design of optimum spacing between posts to minimize time and cost of installation while limiting cable deflection to an acceptable amount during a vehicle impact. The present invention may substantially reduce or eliminate the need for crash testing to determine optimum post spacing for a cable safety system.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION OF THE INVENTION

Figure 1A:
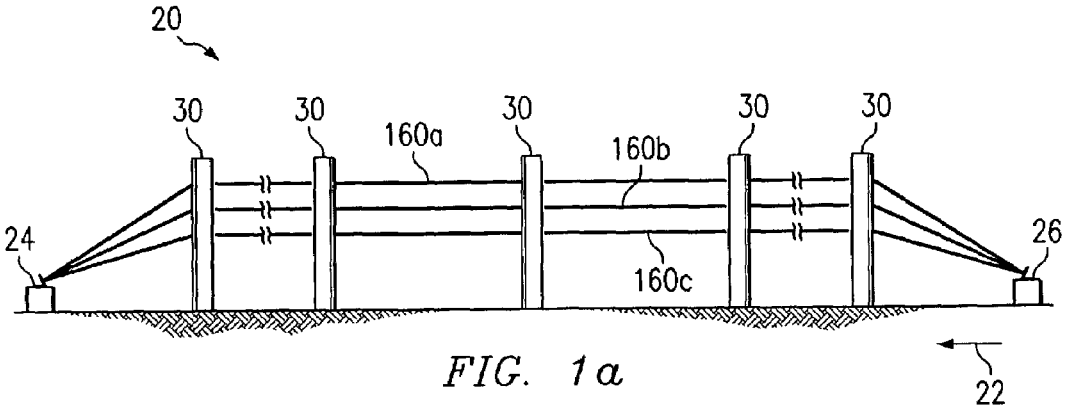
FIG. 1*a* is a schematic drawing in elevation with portions broken away of a cable safety system incorporating teachings of the present invention.
Figure 1B:
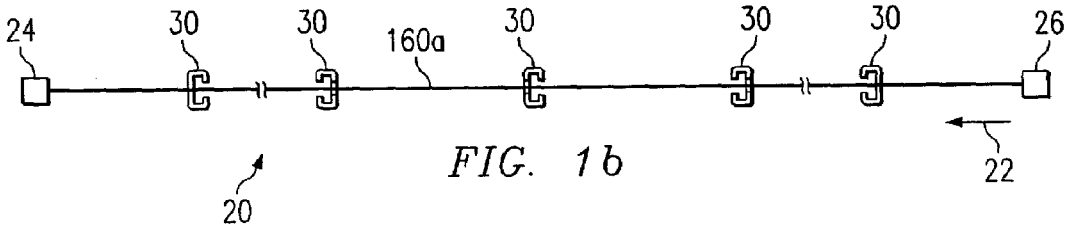
FIG. 1*b* is a schematic drawing showing a plan view with portions broken away of the cable safety system of FIG. 1*a;*
Figure 1C:
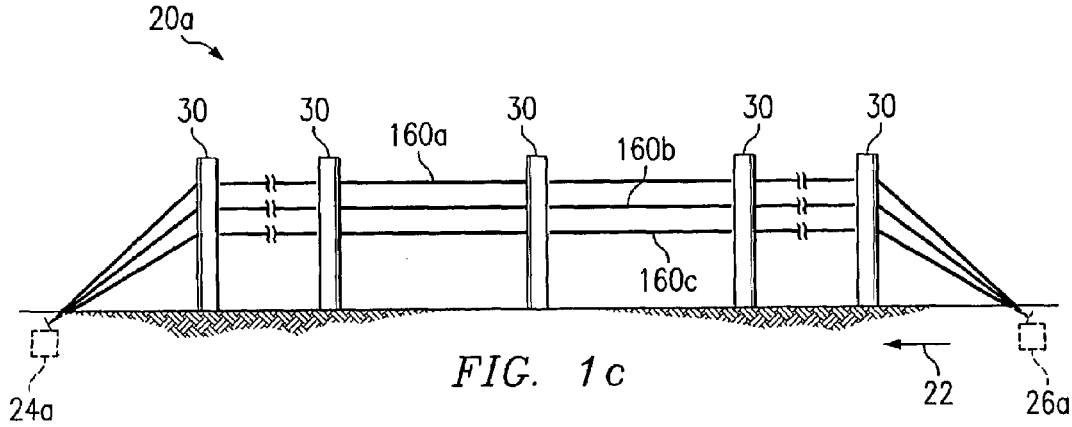
FIG. 1*c* is a schematic drawing in elevation with portions broken away of another cable safety system incorporating teachings of the present invention.

Preferred embodiments of the invention and its advantages are best understood by reference to FIGS. 1*a*–11 wherein like reference numbers indicate like features.

The terms "safety system" or "safety systems" and "barrier" or "barriers" may be used throughout this application to include any type of safety system and/or barrier which may be formed at least in part using cables and support posts incorporating teachings of the present invention. The term "roadway" may be used throughout this application to include any highway, roadway or path satisfactory for vehicle traffic. Safety systems and barriers incorporating teachings of the present invention may be installed in median strips or along shoulders of highways, roadways or any other path which is likely to encounter vehicular traffic.

Various aspects of the present invention will be described with respect to cable safety systems 20 and 20*a*. However, teachings of the present invention may be used to form a wide variety of safety systems and barriers. Cable safety systems 20 and 20*a* may have similar design features and characteristics except cable safety system 20 includes above ground anchors 24 and 26. Cable safety system 20*a* includes below ground anchors 24*a* and 26*a*. The present invention is not limited to cable safety systems 20 and 20*a* as shown in FIGS. 1*a*–1*d*.

Cable safety systems 20 and 20*a* may be installed adjacent to a roadway (not expressly shown) to prevent motor vehicles (not expressly shown) from leaving the roadway and to redirect vehicles away from hazardous areas without causing serious injuries to the vehicle's occupants or other motorists. The general direction of traffic flow along the roadway is illustrated by directional arrow 22.

Cable safety systems 20 and 20*a* may be satisfactorily used as a median, a single barrier installation along the edge of a roadway and at merge applications between adjacent roadways. For some applications, cable safety systems 20 and 20*a* may satisfactorily withstand a second impact before repairs have been made after a first impact. For many applications, cable safety systems 20 and 20*a* may be described as generally maintenance free except for repairs required after a vehicle impact.

Cable safety systems 20 and 20*a* preferably include a plurality of support posts 30 anchored adjacent to the roadway. Posts 30 may be anchored with the ground using various techniques. For some applications a concrete foundation (not expressly shown) may be provided with holes to allow relatively quick and easy insertion and removal of parts. The number, size, shape and configuration of posts 30 may be significantly modified within teachings of the present invention. See for example FIGS. 9–10*i*. Optimum spacing between posts 30 may be designed in accordance with teachings of the present invention. See FIG. 11 for one example.

Various types of cables and/or wire ropes may be satisfactorily used to form a cable safety system in accordance with teachings of the present invention. Cables 160*a*, 160*b* and 160*c* may be substantially identical. However, for some applications each cable of a cable safety system formed in accordance with teachings of the present invention may have different characteristics. Cable safety systems 20 and 20*a* may be generally described as flexible, substantially maintenance free systems with designed low deflection of cables 160*a*, 160*b*, and 160*c* during a vehicle impact. Forming cable safety systems 20 and 20*a* in accordance with teachings of the present invention minimizes damage during a vehicle impact with posts 30 and/or cables 160*a*, 160*b* and 160*c*. For some applications cables 160*a*, 160*b* and 160*c* may be formed from seven strand wire rope. Other types of wire ropes and cables may also be used. See for example FIG. 2.

A plurality of cables 160*a*, 160*b* and 160*c* may be attached to support posts 30 in accordance with teachings of the present invention. Support posts 30 generally maintain associated cables 160*a*, 160*b* and 160*c* in substantially horizontal positions extending along an edge of the roadway. Support posts 30 often allow relative quick and easy repair of cable safety systems 20 and 20*a* after a vehicle impact.

Cable safety systems 20 and 20*a* are generally relatively narrow as compared to conventional W-beam and thrie beam guardrail systems. The length of cables 160*a*, 160*b* and 160*c* may be up to 3,000 meters between anchors 24 and 26 or anchors 24*a* and 26*a*. For other applications the length of cable 160*a*, 160*b* and 160*c* may exceed 3,000 meters without an intermediate anchorage. Support posts 30 maintain desired vertical spacing between cables 160*a*, 160*b* and 160*c* and desired vertical spacing of each cable relative to the ground. Cable safety system 20 and 20*a* including support posts 30 formed in accordance with teachings of the present invention may be designed in accordance with teachings of the present invention to meet or exceed the criteria of NCHRP Report 350 Level 3 requirements.

Cable safety systems 20 and 20*a* preferably include cables 160*a*, 160*b* and 160*c* disposed in slot 40 of each post 30. Cable 160*a*, 160*b* and 160*c* are preferably disposed at different heights relative to the ground and relative to each other. Varying the vertical spacing between cables 160*a*, 160*b* and 160*c* often provides a much wider lateral catch area for vehicles impacting with cable safety systems 20 and 20*a*. The vertical spacing between cables 160*a*, 160*b* and 160*c* may be selected to satisfactorily contain both pickups and, to some extent, even larger vehicles with a relatively high center of gravity, as well as vehicles with a low front profile and low center of gravity.

Cables 160*a*, 160*b* and 160*c* may be prefabricated in approximately three hundred (300) meter lengths with desired fittings attached with opposite ends of each cables 160*a*, 160*b* and 160*c*. Tailor made cables 160*a*, 160*b* and 160*c* may then be delivered to a desired location for installation adjacent to a roadway.

Alternatively, cables 160*a*, 160*b*, and 160*c* may be formed from a single cable stored on a large drum (not expressly shown). Cables stored on drums may often exceed three thousand (3,000) meters in length. Cables 160*a*, 160*b*, and 160*c* may be cut in desired lengths from the cable stored on the drum. Appropriate fittings (not expressly shown) may be swaged or otherwise attached with opposite ends of the respective cable 160*a*, 160*b* and 160*c* at an onsite location. Cables 160*a*, 160*b* and 160*c* may be installed between anchors 24 and 26 or anchor 24*a* and 26*a* with approximately twenty thousand Newtons of tension over a length of approximately three thousand (3,000) meters.

Figure 1D:
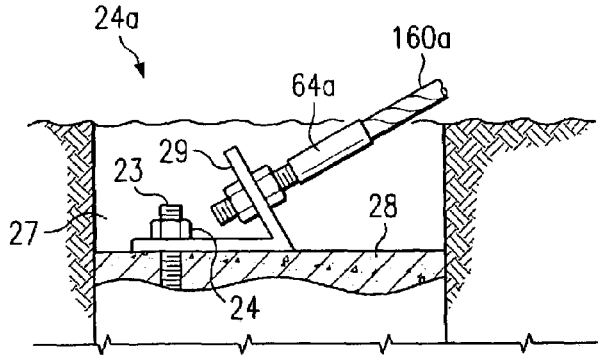
FIG. 1*d* is a schematic drawing in section and in elevation with portions broken away of a below ground cable anchor assembly satisfactory for use with the cable safety system of FIG. 1*c;*

FIG. 1*d* shows one example of a below ground anchor which may be satisfactorily used with a cable safety system incorporating teachings of the present invention. Respective holes 27 may be formed in the ground at desired locations for anchors 24*a* and 26*a*. A portion of each hole 27 may be filled with concrete foundation 28. Anchor plate 29 may be securely engaged with concrete foundation 28 using various types of mechanical fasteners, including, but not limited to, a plurality of bolts 23 and nuts 24. Anchor plate 29 may be formed at an appropriate angle to accommodate the design of cable safety system 20*a*. Also multiple slots and/or openings (not expressly shown) may be formed in anchor plate 29 to receive respective end fittings 64.

For the embodiment of the present invention as shown in FIG. 1*d*, end fitting 64*a* of cable 160*a* is shown engaged with anchor plate 29. Various types of anchor assemblies and cable end fittings may be satisfactorily used with a cable safety system incorporating teachings of the present invention. The present invention is not limited to anchor 24*a* or end fittings 64*a* as shown in FIG. 1*d*.

Figure 2:
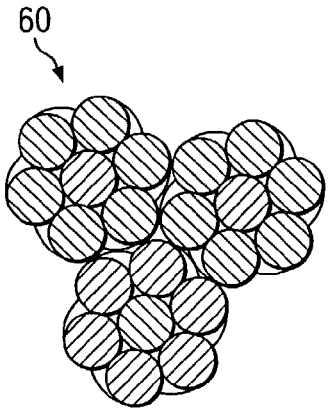
FIG. 2 is a schematic drawing in section showing one example of a cable satisfactory for use in forming a cable safety system incorporating teachings of the present invention.

Cable 60 as shown in FIG. 2 may be formed from three groups of seven strand wire° rope. Cable 60 may be used to form cable safety systems 20 and/or 20*a*. Cable 60 may have a modulus of elasticity of approximately 8,300 kilograms (kg) per square millimeter (mm). The diameter of each strand used to form cable 60 may be approximately three (3) mm. The diameter of cable 60 may be approximately nineteen (19) mm. Cable 60 may be pre-stressed to approximately fifty percent (50%) of designed or rated breaking strength. One or more cables 60 may be used to replace cables 160*a*, 160*b*, and/or 160*c* of cable safety systems 20 and 20*a*.

Figure 3:
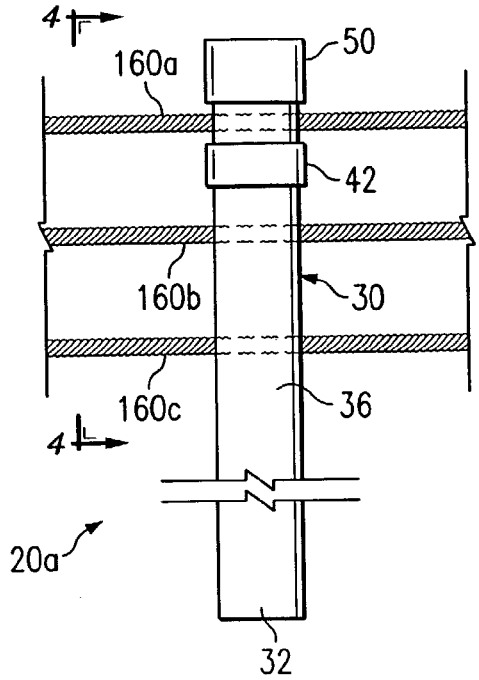
FIG. 3 is a schematic drawing in elevation with portions broken away showing one example of a post and attached cables incorporating teachings of the present invention.
Figure 4:
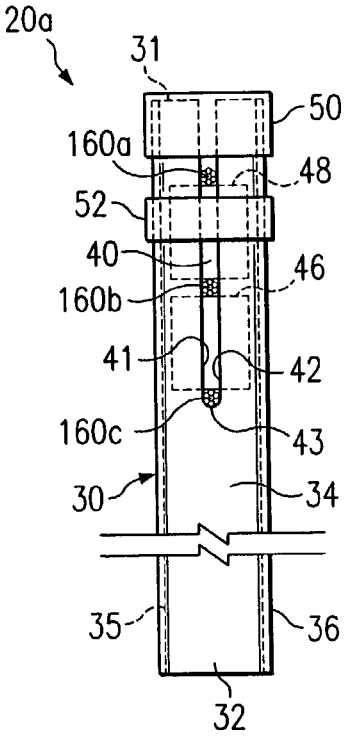
FIG. 4 is a schematic drawing taken along lines 4—4 of FIG. 3.
Figure 5:
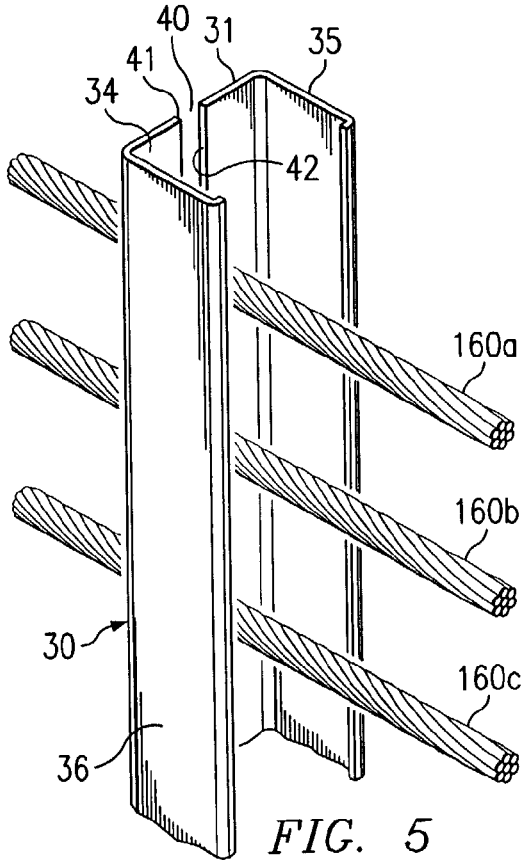
FIG. 5 is a schematic drawing showing an isometric view with portions broken away of a post and cables incorporating teachings of the present invention.
Figure 7:
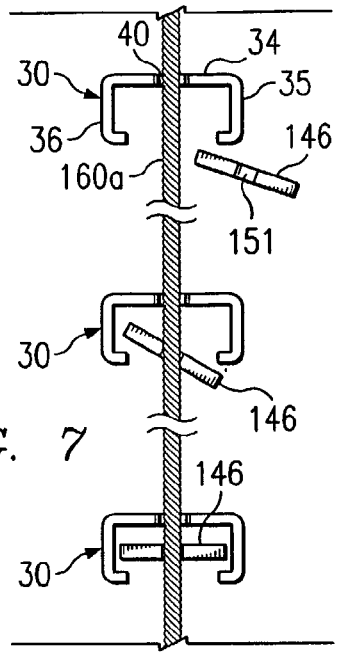
FIG. 7 is a schematic drawing showing one method for installing the spacer of FIG. 6 with the post and cables of FIG. 5.

One example of support posts 30 and cables 160*a*, 160*b* and 160*c* which may be satisfactorily used to form cable safety system 20 in accordance with teachings of the present invention is shown in FIGS. 3, 4 and 5. Post 30 includes first end 31 and second end 32. For this embodiment of the present invention, post 30 includes a generally C-shaped cross section defined in part by web 34 with respective legs 35 and 36 extending therefrom. As best shown in FIGS. 5 and 7, the extreme edge of each leg 35 and 36 opposite from web 34 are preferably rounded or bent inward to eliminate any sharp edges. Support post 30 preferably has a generally "rounded" or "soft" profile. For some applications post 30 may be formed using roll forming techniques.

Figure 8A:
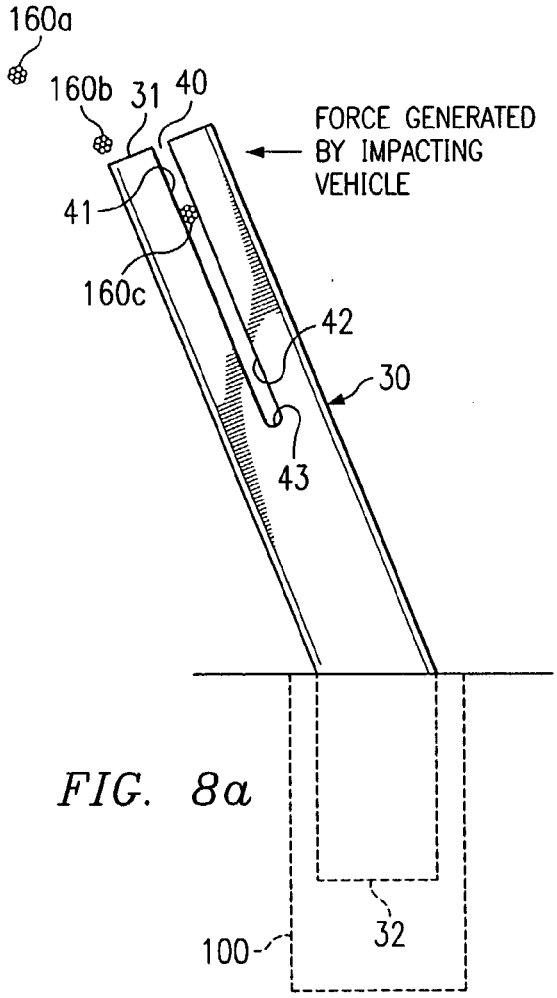
FIG. 8*a* is a schematic drawing in section and in elevation showing one example of the results of a vehicle impacting a cable safety system.
Figure 8B:
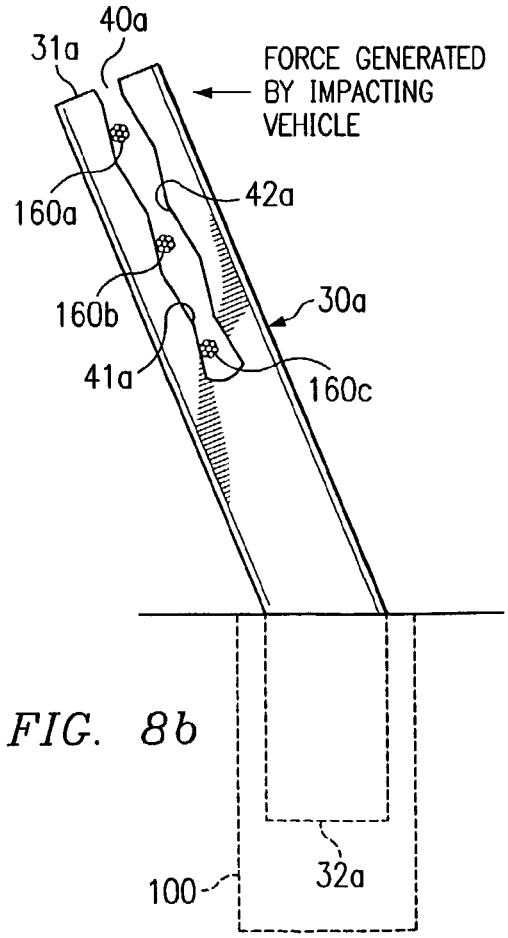
FIG. 8*b* is a schematic drawing in section and in elevation showing one example of the results of a vehicle impacting a cable safety system incorporating teachings of the present invention.

For some applications second end 32 of each post 30 may be installed in a concrete foundation or footing 100 such as shown in FIGS. 8*a* and 8*b*. Steel sockets (not expressly shown) may also be used to install posts 30 in footing 100. For other applications a foot plate (not expressly shown) may be attached to second end 32 of each post 30 for use in bolting or otherwise securely attaching posts 30 with a larger foot plate (not expressly shown) cast into a concrete foundation or similar structure adjacent to a roadway. Alternatively, second end 32 may be inserted directly into the ground. One or more soil plates (not expressly shown) may be attached to posts 30 proximate respective second ends 32 when posts 30 are installed directly into the ground adjacent to a roadway.

Slot 40 is preferably formed in web 34 extending from first end 31 towards second end 32. The length of slot 40 may be selected in part based on desired vertical spacing of cable 160*c* relative to the adjacent roadway. The length of slot 40 may also be selected to accommodate the number of cables which will be installed therein and desired vertical spacing between each cable. Slot 40 may have a generally elongated U-shaped configuration defined in part by first edge 41, second edge 42 and bottom 43. For the embodiment of the present invention as shown in FIGS. 3–5, first edge 41 and second edge 42 may have a generally smooth profile and extend generally parallel with each other. Forming slot 40 within web 34 of post 30 eliminates requirements for bolts, hooks or other mechanical attachments to releasably secure cables 160*a*, 160*b* and 160*c* with post 30.

For some applications post 30 may be formed from metal sheet having a thickness of four millimeters, a length varying approximately from 700 mm to 1,600 mm, and a width of approximately 350 mm. The metal sheet may weigh approximately 7.8 kilograms (kg) per meter. For other applications post 30 may be formed from a metal sheet having a thickness of four millimeters, a length varying approximately from 700 mm to 1,600 mm, a width of approximately 310 mm and a weight of less 4.5 kg per meter.

Respective caps 50 may be placed on first end 31 of each post 30. Retaining band or bands 52 may be placed on the exterior of one or more posts 30 to provide additional strength. Cap 50 and retaining band 52 may be formed from various types of metals, elastomeric materials and/or composite materials. For some applications retaining band 52 may be formed from a relatively strong steel alloy to provide additional support to allow post 30 to handle forces imposed on edges 41 and 42 by cables 160*a*, 160*b* and 160*c* during a vehicle impact with cable safety system 20.

During installation of a cable safety system, cable 160*c* may be disposed within slot 40 resting on bottom 43 thereof. Since post 30 has a partially closed cross section defined in part by the bent or rounded edges of legs 35 and 36, a relatively simple first spacer 46 may be inserted or dropped into post 30 to rest on cable 160*c* opposite bottom 43. Spacer 46 may be a block having a generally rectangular configuration with a thickness satisfactory for insertion within the cross section of post 30. The height of spacer 46 is preferably selected to correspond with desired vertical spacing between cables 160*c* and 160*b*.

Cable 160*b* may be inserted into slot 40 after spacer 46 has been disposed on cable 160*c*. Spacer 48 may then be installed within slot 40 with one end resting on cable 160*b* opposite from spacer 46. The height of spacer block 48 is preferably selected to correspond with desired vertical spacing between cables 160*b* and 160*a*. Spacer 48 may be a block having a generally rectangular configuration with a thickness satisfactory for insertion within the cross section of post 30.

Cable 160*a* may then be installed within slot 40 resting on spacer 48 opposite from cable 160*b*. One or more retaining bands 52 may be secured with the exterior of post 30 between cables 160*a* and 160*b* and/or cables 160*b* and 160*c*. Cap 50 may be placed over first end 31 of post 30 after installation of cables 160*a*, 160*b* and 160*c* and spacers 46 and 48.

Figure 6:
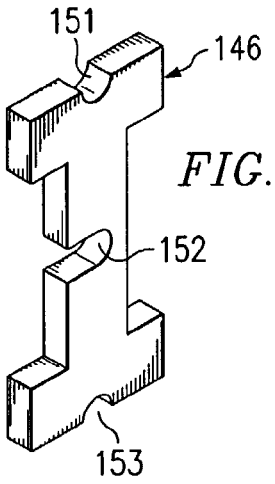
FIG. 6 is a schematic drawing showing an isometric view of one example of a spacer incorporating teachings of the present invention.

FIG. 6 shows one example of a single spacer which may be satisfactorily used to position cables 160*a*, 160*b* and 160*c* within slot 40 at desired vertical spacings relative to each other. Spacer 146 formed in accordance with teachings of the present invention eliminates the need for separate spacers 46 and 48. For the embodiment of the present invention as shown in FIG. 6, spacer 146 has a generally I-shaped configuration. Recesses 151 and 153 may be formed in opposite ends of spacer 146. Another recess 152 may be formed in one edge of spacer 146 intermediate the ends thereof. The dimensions of recesses 151, 152 and 153 are preferably selected to accommodate the outside diameter of cables 160*a*, 160*b* and 160*c*. The respective distances between recesses 151, 152 and 153 are preferably selected to correspond with desired vertical spacing between corresponding cables 160*a*, 160*b* and 160*c*. Various types of spacers and inserts may be satisfactorily used to install cables within slots of support posts incorporating teachings of the present invention. The present invention is not limited to use with spacers 46, 48 and 146.

Spacers 46, 48 and 146 may be formed from a wide variety of materials including polymeric materials, elastomeric materials, recycled materials, structural foam materials, composite materials, wood and/or lightweight metal alloys. For some applications spacers 46, 48 and 146 may be formed from recycled rubber and/or other recycled plastic materials. The present invention is not limited to forming spacers 46, 48 and 146 from any specific type of material or with any specific dimensions or configurations.

Typical installation procedures for a cable safety system incorporating teachings of the present invention includes installing posts 30 along with anchors 24 and 26 or anchor 24*a* and 26*a* at desired locations adjacent to a roadway and/or median (not expressly shown). Cables 160*a*, 160*b* and 160*c* may be rolled out and placed on the ground extending generally longitudinally between anchors 24 and 26 or anchors 24*a* and 26*a*. Spacers 46 and 48 or spacers 146, retaining bands 52 and end caps 50 may also be placed adjacent to each post 30 as desired for the specific installation. Cables 160*a*, 160*b* and 160*c* may include prefabricated fittings satisfactory for engagement with anchors 24 and 26 or anchors 24*a* and 26*a*. Alternatively, appropriate fittings (not expressly shown) may be attached with each end of respective cables 160*a*, 160*b* and 160*c*.

One end of each cable 160*a*, 160*b* and 160*c* may be connected with a respective first anchor. Appropriate tension may then be applied to each cable 160*a*, 160*b* and 160*c* corresponding to a value of approximately 95% of the desired tension depending upon anticipated ambient temperature and other environmental conditions. Each cable 160*a*, 160*b* and 160*c* may then be marked, cut and an appropriate fitting attached. The other end or the second end of each cable may then be coupled with a respective second anchor. Conventional procedures may be used to adjust the tension in cables 160*a*, 160*b* and 160*c* to the desired values. Appropriate spacers 46 and 48 or 146 may then be inserted within each post 30. Retaining bands 52 and end caps 50 may then be attached to each post.

For some applications, one end of each cable 160*a*, 160*b* and 160*c* may be attached with anchor 24 or 24*a*. Cables 160*a*, 160*b* and 160*c* may then be extended horizontally through each slot 40 formed in respective support posts 30. The opposite end of each cable 160*a*, 160*b* and 160*c* may then be attached to second anchor 26 or 26*a* with a selected amount of tension placed on each cable 160*a*, 160*b* and 160*c*. Respective spacers 146 may then be inserted into each support post 30 to provide desired vertical spacing between cables 160*a*, 160*b* and 160*c*. FIG. 7 is a schematic drawing which shows one example of installing spacers 146 within posts 30 after placing desired tension on cables 160*a*, 160*b* and 160*c* disposed within each slot 40.

FIG. 8*a* is a schematic drawing showing one example of the results of a vehicle impact with cables 160*a*, 160*b* and 160*c* adjacent to post 30. The force of the impacting vehicle will tend to bend post 30 from a generally vertical position towards a horizontal position. Cables 160*a*, 160*b* and 160*c* will tend to slide from or be released from associated slot 40 as the angle of bending of post 30 from a vertical position increases.

High-speed films from full scale crash testing of vehicles with cable safety systems have demonstrated that posts installed immediately adjacent to the location of a vehicle impact with unsupported portions of the cables will bend and/or deform in response to forces placed on the posts by the cables. When a post is bent at an angle of approximately ten degrees (10°) from vertical, the upper cable of a three cable safety system will often slide out of a slot with uniform, parallel edges or a conventional hook (not expressly shown) and lose its retaining capabilities. After another couple of degrees of the post bending from vertical, the second cable will slide out of a slot with uniform, parallel edges or a conventional hook. Finally, the third cable will slide out of a slot with uniform, parallel edges or a conventional hook when the post is bent approximately twenty eight to thirty degrees (28° to 30°) from vertical. As cables are released from posts adjacent to the point of vehicle impact, deflection of the cables will increase significantly.

One aspect of the present invention includes forming one or more restrictions within each slot to help retain associated cables within the respective slot when a vehicle impacts the associated safety barrier. Support post 30*a* is shown in FIG. 8*b* with cables 160*a*, 160*b* and 160*c* retained within slot 40*a* by restrictions formed along edges 41*a* and 42*a*. As a result of the restrictions formed within slot 40*a*, cables 160*a*, 160*b* and 160*c* will be retained within slot 40*a* when post 30*a* is bent at approximately the same angles from vertical which resulted in release of cable 160*a*, 160*b* and 160*c* from slot 40 of post 30. See FIGS. 8*a* and 8*b*.

Figure 9:
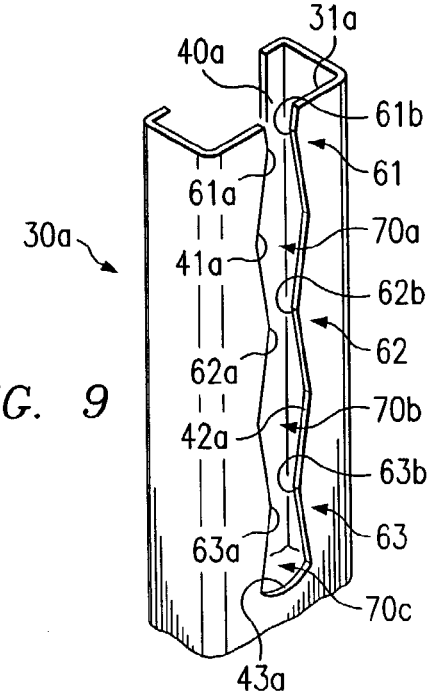
FIG. 9 is a schematic drawing in elevation with portions broken away showing another example of a post formed in accordance with teachings of the present invention.

FIG. 9 is an enlarged schematic drawing showing post 30*a* having slot 40*a* form thereon with a plurality of restrictions and/or projections formed in each edge 41*a* and 42*a*. For the embodiment of the present invention as shown in FIG. 9 the location and configurations of the restrictions formed in edges 41*a* and 42*a* are selected to correspond generally with the desired location for associated cables 160*a*, 160*b* and 160*c*. Restrictions 61, 62 and 63 of slot 40*a* may be defined in part by respective projections 61*a*, 61*b*; 62*a*, 62*b*, 63*a*, 63*b*. Edges 41*a* and 42*a* of slot 40*a* preferably include alternating tapered or sloping surfaces which form respective projections 61*a*, 61*b*; 62*a*, 62*b* and 63*a*, 63*b*. The same tapered or sloping surfaces also form respective enlarged openings 70*a*, 70*b* and 70*c* within slot 40*a*. The location of enlarged openings 70*a*, 70*b* and 70*c* are preferably selected to correspond with approximate desired locations for cables 160*a*, 160*b* and 160*c*. The gap or spacing formed between respective projections 61*a* and 61*b*, 62*a* and 62*b* and 63*a* and 63*b* is generally selected to be greater than the outside diameter of cables 160*a*, 160*b* and 160*c*. Specific dimensions between the respective projections are selected to provide optimum resistance to disengagement between cables 160*a*, 160*b* and 160*c* as post 30*a* with slot 40*a* is bent from a generally vertical position towards a horizontal position and still allow easy installation of cables 160*a*, 160*b* and 160*c* in slot 40*a*.

FIGS. 10*a*–10*i* are schematic drawings showing various cross sections for support posts incorporating teachings of the present invention. Post 130*a*, 130*c*, 130*d*, 130*f*, 130*g* and 130*h* do not have any sharp edges or hooks exposed to vehicle traffic traveling along an adjacent roadway. Configurations with hooks and/or sharp edges may present hazards for motorcyclists, bicycle riders and other users of an adjacent roadway. Respective slots 40 are shown formed in each post 130*a*–130*h* to receive respective cables therein. Alternatively, respective slots 40*a* with restrictions 61, 62 and 63 may be formed in each post 130*a*–130*h*.

Figure 10A:
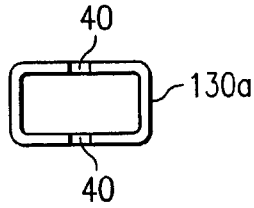
FIGS. 10*a*–10*i* are schematic drawings in section showing further examples of posts incorporating teachings of the present invention.
Figure 10B:
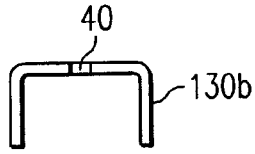
Figure 10C:
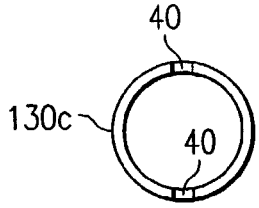
Figure 10D:
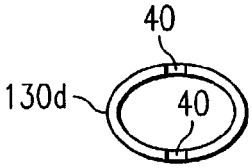

Post 130*a* as shown in FIG. 10*a* may be described as having a generally rectangular cross section. Post 130*b* as shown in FIG. 10*b* may be described as having a generally U-shape cross section. Post 130*c* as shown in FIG. 10*c* may be described as having a generally circular cross section. Post 130*d* as shown in FIG. 10*d* may be described as having a generally oval shaped and/or elliptical shaped cross section.

Figure 10E:
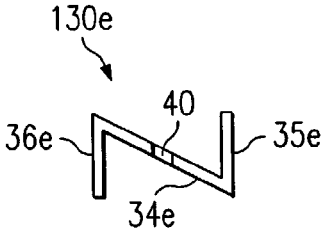

Post 130*e* as shown in FIG. 10*e* may be described as having a generally N-shape cross section. For some applications the ends of legs 35*e* and 36*e* may be bent or rounded (not expressly shown). Also, the intersection of web 34*e* with legs 35*e* and 36*e* may be rounded.

Figure 10F:
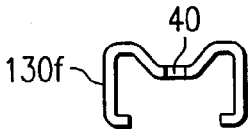
Figure 10G:
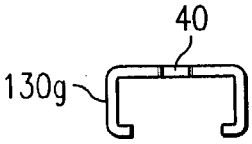

Post 130*f* as shown in FIG. 10*f* may be described as having a generally M-shape cross section. Post 130*g* as shown in FIG. 10*g* may be described as having a generally C-shape cross section. Post 130*i* as shown in FIG. 10*i* may be described as having a generally "I-shape."

Figure 10H:
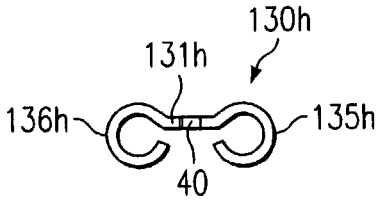
Figure 10I:
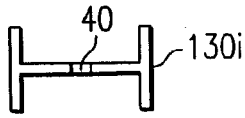

Post 130*h* as shown in FIG. 10*h* has a cross section defined in part by a generally straight segment or web 131*h* with respective curved segments 135*h* and 136*h* disposed on each end of straight segment or web 131*h*.

Standards have been developed within the European standardisation body, CEN (Commite Europeen de Normalisation), for impact tests performed on safety systems and barriers. These barrier impact tests are described in CEN 1317, Road Restraint Systems. According to the CEN standards, safety systems and barriers are to be impact tested at different containment levels. The elongation or deformation of a barrier is also measured to determine a safe working width. The environment in which the barrier is to be constructed generally determines appropriate containment level as well as permissible working width. The CEN standard generally requires that the risk of injury in a collision with the barrier is minimized (injury risk class). CEN standards are used in the European countries and several countries near Europe as well as Australia and New Zealand, among others.

NCHRP stands for the National Cooperative Highway Research Program, a program developed by the Transportation Research Board of the National Research Council, USA. Report 350 is entitled "Recommended Procedures for the Safety Performance Evaluation of Highway Features". The standard describes how impact tests should be conducted. Test results may be used to determine elongation or deformation and safe working widths. This standard is used mainly in the USA.

Figure 11:
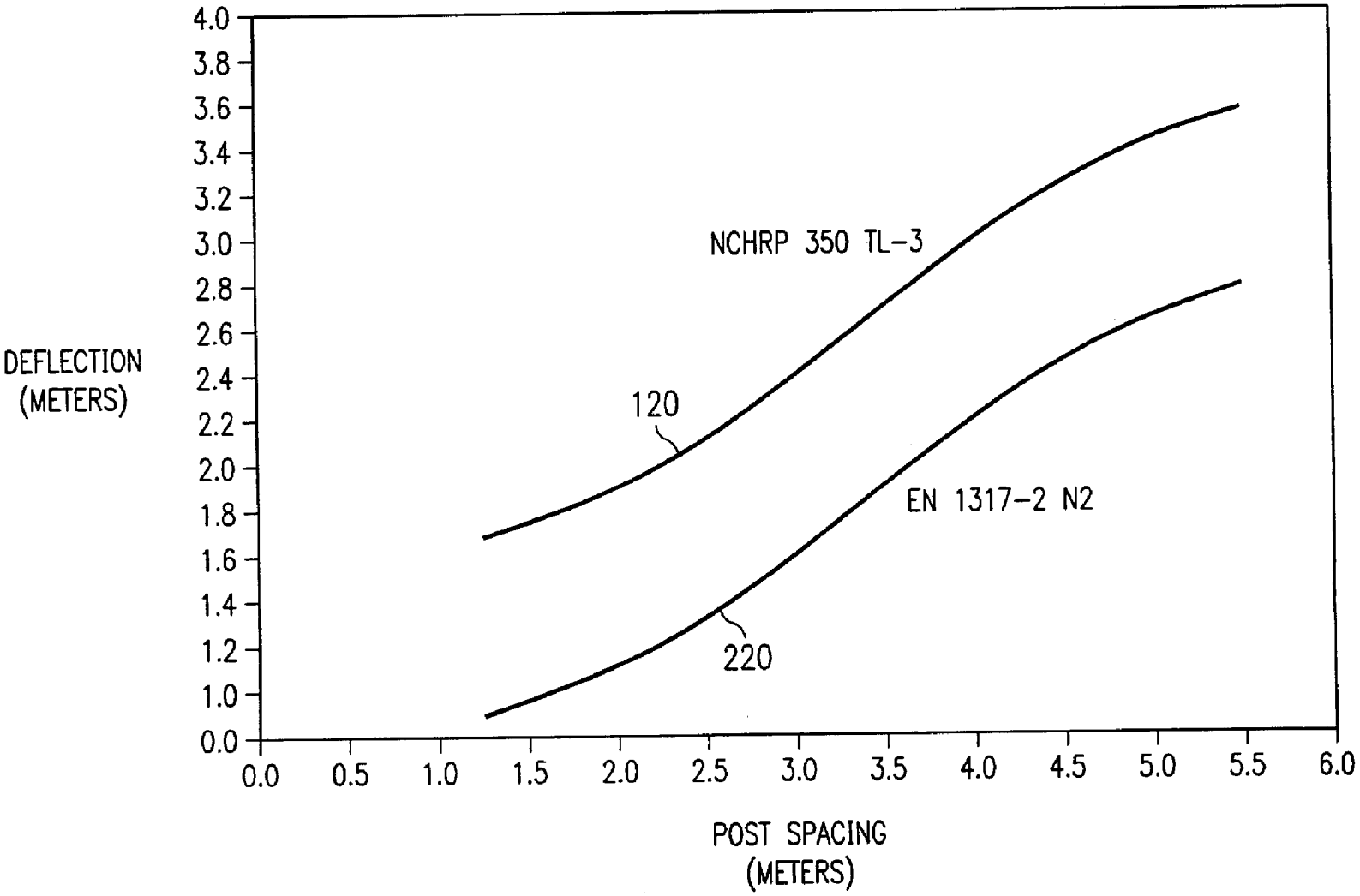
FIG. 11 shows one example of graphs which may be used to design optimum spacing between posts of a cable safety system to limit deflection during vehicle impact in accordance with teachings of the present invention.

FIG. 11 shows one example of a graph which may be used to design spacing between posts of a cable safety system. For some applications, crash testing may be conducted in accordance with applicable standards for highway safety equipment such as NCHRP report 350 Level 3 requirements (see graph 120) or European standard EN 1317-2 N2 for roadway safety barriers (see graph 220). Such standards typically include impact testing requirements including vehicle speed, vehicle weight and angle of impact.

Graphs or curves 120 and 220 may be based at least in part on crash testing of vehicles in accordance with respective NCHRP and EN 1317 standards. Spacing between respective support posts formed in accordance with teachings of the present invention may be varied in increments such as two meters, three meters and five meters for each test. During each vehicle impact, deflection measurements may be taken using a high speed camera or other suitable technology. The resulting graphs may be used to determine post spacing for a desired cable deflection.

Support posts having slots and restrictions formed in accordance with teachings of the present invention generally provide very predictable results during a crash test. Impact tests with support posts spacings of two meters, three meters and five meters may result in a graph or curve which provides a relatively accurate indication of deflection at other post spacings. Thus, the present invention will often eliminate the need for additional crash testing to confirm that a selected post spacing will limit cable deflection to a desired maximum value during a vehicle impact.

Although the present invention and its advantages have been described in detail, it should be understood that various changes, substitutions and alternations can be made herein without departing from the spirit and scope of the invention as defined by the following claims.

What is claimed is:

1. A safety barrier installed adjacent to a roadway comprising:

a plurality of posts spaced from each other and disposed adjacent to the roadway;

each post having a generally C-shaped cross section defined in part by a web and a pair of legs extending therefrom;

each post having one slot formed in the web of the post and extending from an upper end of the post;

at least two cables releasably engaged with and supported by the posts;

each slot having a first edge and a second edge with respective sloping surfaces operable to slidably receive the at least two cables therein;

the sloping surfaces on the first edge of each slot providing a first projection;

the sloping surfaces on the second edge of each slot providing a second projection;

the cables disposed within each slot between the respective legs of each post;

the posts and the at least two cables cooperating with each other to prevent a vehicle from leaving the roadway; and at least one spacer disposed within the generally C-shaped cross section of each post to maintain the cables at desired locations within the respective slot.

2. The safety barrier of claim 1 wherein at least one of the slots comprises multiple projections formed on each edge to help retain the cables in the at least one slot as the associated post is bent by a vehicle colliding with the safety barrier.

3. The safety barrier of claim 1 further comprising at least one retaining band secured to the exterior of each post to aid in releasably engaging the cables with the associated post.

4. The safety barrier of claim 1 further comprising a respective cap releasably secured with an upper end of each post.

5. The safety barrier of claim 1 further comprising:

at least one restriction formed on least one edge of each slot to help retain the cables in the respective slots for a longer time period when a vehicle impacts the safety barrier;

at least a first cable, a second cable, and a third cable disposed with each slot;

a respective first spacer disposed within each post between the first cable and the second cable; and a respective second spacer disposed within each post between the second cable and the third cable.

6. A post for installing a cable safety system adjacent to a roadway, the post comprising:

a generally C-shaped cross section defined in part by a web and a pair of legs extending from the web;

each leg having an extreme end opposite from the web;

each extreme end bent inward;

a first end and a second end with a slot formed in the web starting at the first end and extending partially along the length of the post;

the second end satisfactory for installation adjacent to a roadway;

the slot having a first edge and a second edge;

the slot sized to allow placing at least two cables therein;

at least one restriction defined in part by respective sloping surfaces formed on each edge of the slot to increase retention time of the cables within the slot as the post is bent from a generally vertical position during a vehicle impact with the cables disposed within the slot;

the sloping surfaces on the first edge of each slot providing a first projection;

the sloping surfaces on the second edge of each slot providing a second projection; and at least one spacer disposed within the generally c-shaped cross section of the post operable to maintain the cables at a desired spacing within the slot.

7. The post of claim 6 wherein the slot further comprises:

a generally elongated U shaped configuration defined in part by the first edge, the second edge and a bottom opposite from the first end of the post; and multiple restrictions formed on the first edge and the second edge of the slot.

8. A method of installing a cable safety system adjacent to a roadway comprising:

forming a plurality of posts with each post having a slot extending from an upper end of the post;

forming the slot with a first edge and a second edge;

forming respective tapered surfaces on the first edge to provide a first projection;

forming respective tapered surfaces on the second edge to provide a second projection;

forming at least one restriction within each slot defined in part by the first projection extending from the first edge and the second projection extending from the second edge to increase retention of the cables within the slot as the respective posts are bent from a generally vertical position;

installing the plurality of posts spaced from each other proximate to the roadway;

releasably engaging at least two cables with each of the posts to prevent a vehicle from leaving the roadway; and placing at least one spacer within each post to maintain the cables at desired spacing within the respective slots.

9. The method of claim 8 further comprising:

placing at least a first cable, a second cable, and a third cable within each slot of each post;

placing a first spacer within each post between the first cable and the second cable; and placing a second spacer within each post between the second cable and the third cable.

10. The method of claim 8 further comprising securing at least one retaining band to the exterior of the post to aid in releasably engaging the cables with the slot formed in each post.

11. The method of claim 8 further comprising releasably securing a respective cap with the upper end of each post.

12. A method for manufacturing a support post for a cable safety system comprising:

forming the post with a first end and a second end;

forming the post with a generally C-shaped cross section defined in part by a web and a pair of legs extending therefrom;

forming a slot in the web extending from the first end of the post; forming the slot with a first edge and a second edge; forming respective tapered surfaces on the first edge to provide a first projection and respective tapered surfaces on the second edge to provide a second projection with the the first projection extending from the first edge and the second projection extending from the second edge to increase retention of at least one cable in the slot as the post bends from a generally vertical position during a vehicle impact with the cable safety system;

forming at least one spacer disposed within the generally c-shaped cross section of the post operable to maintain at least a first cable and a second cable at a desired spacing within the slot.

13. The method of claim 12 further comprising forming multiple projections defined in part by respective tapered surfaces on each edge of the slot to retain at least a first cable and a second cable in the slot at a larger release angle when the post is bent from a generally vertical position as compared with release angles associated with bending of a post with a slot having no restrictions.

* * * * *

UNITED STATES PATENT AND TRADEMARK OFFICE

CERTIFICATE OF CORRECTION

PATENT NO. : 6,962,328 B2
APPLICATION NO. : 10/442597
DATED : November 8, 2005
INVENTOR(S) : Peter Bergendahl It is certified that error appears in the above-identified patent and that said Letters Patent is hereby corrected as shown below:

Title Page, Item (56) Other Publications, insert -- International Search Report PCT/US03/16414 --.
Column 2, Line 36, after “must”, delete “to” .
Column 2, Line 65, after “Support”, delete “post”, and insert --posts --.
Column 3, Line 14, after “Support”, delete “post”, and insert -- posts --.
Column 7, Lines 19-20, after “from”, insert -- a --.
Column 7, Line 27, after “less”, insert -- than --.
Column 11, Line 62, after “on”, insert -- at --.
Column 12, Line 28, after “generally”, delete “c-shaped”, and insert --C-shaped --.
Column 13, Line 18, after “with the”, delete “the”.
Column 14, Line 5, after “system”, insert -- and --.
Column 14, Line 7, after “generally”, delete “c-shaped”, and insert -- C-shaped --.

Signed and Sealed this

Ninth Day of January, 2007

JON W. DUDAS
*Director of the United States Patent and Trademark Office*